US006146434A

United States Patent [19]

Scalfani et al.

[11] Patent Number: 6,146,434

[45] Date of Patent: Nov. 14, 2000

[54] CYCLONIC DIRT CUP ASSEMBLY

[75] Inventors: Adam C. Scalfani; Douglas E. Gerber; A. Ronald Keebler, all of North Canton; Raymond L. Lawter, Millersburg; Daniel R. Miller, Canton, all of Ohio

[73] Assignee: The Hoover Company, North Canton, Ohio

[21] Appl. No.: 09/257,087

[22] Filed: Feb. 24, 1999

[51] Int. Cl.[7] ..... B01D 45/16

[52] U.S. Cl. ..... 55/334; 55/335; 55/368; 55/DIG. 3; 96/385; 15/348; 15/353

[58] Field of Search ..... 55/334, 335, 368, 55/DIG. 3; 96/385; 15/348, 353

[56] References Cited

U.S. PATENT DOCUMENTS

| | | | |
|---|---|---|---|
| 1,033,164 | 7/1912 | Fahrney . | |
| 1,768,617 | 7/1930 | Lee . | |
| 3,146,081 | 8/1964 | Emdy . | |
| 3,320,727 | 5/1967 | Farley et al. | 55/DIG. 3 |
| 3,870,486 | 3/1975 | Eriksson et al. | 96/385 |
| 3,877,902 | 4/1975 | Eriksson et al. . | |
| 3,921,250 | 11/1975 | Jerabek . | |
| 4,268,288 | 5/1981 | Coombs . | |
| 4,443,235 | 4/1984 | Brenholt et al. | 96/385 |
| 4,826,515 | 5/1989 | Dyson . | |
| 4,853,011 | 8/1989 | Dyson . | |
| 5,080,697 | 1/1992 | Finke . | |
| 5,145,499 | 9/1992 | Dyson | 55/DIG. 3 |
| 5,171,340 | 12/1992 | Karmel | 55/DIG. 3 |
| 5,307,538 | 5/1994 | Rench et al. . | |
| 5,681,363 | 10/1997 | Tucker et al. . | |
| 5,735,403 | 4/1998 | Stiglianese . | |
| 5,779,745 | 7/1998 | Kilstrom . | |
| 5,958,113 | 9/1999 | Collins et al. | 55/DIG. 3 |
| 5,961,676 | 10/1999 | King et al. | 55/DIG. 3 |

FOREIGN PATENT DOCUMENTS

| | | |
|---|---|---|
| 1241158 | 8/1988 | Canada . |
| 018197 A1 | 10/1980 | European Pat. Off. . |
| 827710 A2 | 3/1998 | European Pat. Off. . |

OTHER PUBLICATIONS

Photographs of Dyson Canister Model DC02, Received Apr. 10, 1995 (2 pages).

Photos of Eureka Whirlwind Upright—model 4380, Received Apr. 16, 1998.

Photos of Royal Vision Upright—Model 086915, Received Oct. 1998.

Photos of Iona Thunder—Model 12052, Received Dec. 1993.

Photos of Iona Fury—Model F10051, Received Mar. 1996.

*Primary Examiner*—Duane Smith
*Assistant Examiner*—Minh-Chau T. Pham
*Attorney, Agent, or Firm*—A. Burgess Lowe

[57] ABSTRACT

A cyclonic dirt cup assembly for a vacuum cleaner has a generally conical truncated cone positioned within a dirt cup of the vacuum cleaner. The dirt cup has a wall formed with an air inlet opening for receiving a stream of dirt-laden air within the dirt cup. The cone is pivotally connected to a frame member which is removably mounted within the dirt cup. A baffle extends outwardly from a wall of the cone and is positioned adjacent the air inlet opening of the dirt cup for directing the stream of dirt-laden air in a cyclonic manner. The baffle includes a top wall, a side wall and a bottom wall. The baffle walls, the wall of the dirt cup and a wall of the cone form an air directing compartment which receives the dirt-laden air input through the inlet opening. The air directing compartment is formed with a side exit opening which provides a tangential opening for the dirt-laden air to exit the air directing compartment and begins a cyclonic action within the container for filtering dirt particles from the airstream. A filter is positioned on the frame member opposite the cone for further filtering the airstream. The cone pivots away from the frame member to provide access to the filter for cleaning thereof.

20 Claims, 5 Drawing Sheets

CYCLONIC DIRT CUP ASSEMBLY

BACKGROUND OF THE INVENTION

1. Technical Field

The invention relates to vacuum cleaners. Particularly, the invention relates to cyclonic separators for vacuum cleaners. Even more particularly, the invention relates to a cyclonic dirt cup assembly having a generally conical truncated cone which directs a dirt-laden airstream in a cyclonic manner within a dirt cup to separate dirt particles from a stream of dirt-laden air.

2. Background Information

It is well known in the art of vacuum cleaners to use cyclonic action to separate particles from a stream of air. Typically, in these vacuum cleaners, a stream of dirt-laden air is directed tangentially into a container or dirt cup either within or around the outside of a generally cone-shaped member. The tangential input of the dirt-laden air creates a cyclonic action within the dirt cup which is maintained by the cone-shaped member. The cyclonic action within the dirt cup allows the larger dirt particles to fall from the airstream due to the force of gravity. Because many of the smaller dirt particles are not filtered from the airstream by the cyclonic action, vacuum cleaners having cyclonic separators will typically include a final filter, such as a filter bag or filter cassette, to filter these smaller dirt particles from the dirt-laden airstream before the airstream is exhausted into the atmosphere.

Although these prior art vacuum cleaners using cyclonic action within a dirt cup to separate dirt particles from an airstream are adequate for the purpose for which they are intended, it may be inconvenient or undesirable to input the dirt-laden airstream into the cyclonic separator tangentially. Additionally, even those vacuum cleaners which do input the air tangentially may not create a sufficient cyclonic action within the dirt cup to adequately separate the dirt particles from the dirt-laden air stream. Further, herertofore, many manipulatable vacuum cleaners having cyclonic separators have been relatively expensive and have required rather intricate elaborate ducting arrangements to create the cyclonic action.

Therefore, the need exists for a cyclonic dirt cup assembly which is inexpensive, which allows the dirt-laden airstream to be input into the dirt cup at various angles, and which creates and maintains sufficient cyclonic action within the dirt cup to provide adequate dirt and air separation.

SUMMARY OF THE INVENTION

Objectives of the invention include providing an improved cyclonic dirt cup assembly which is capable of receiving a stream of dirt-laden air input into the dirt cup at various angles, and which directs the input dirt-laden airstream tangentially within the dirt cup to create a cyclonic action therein.

A further objective is to provide such a cyclonic dirt cup assembly which is inexpensive and which is capable of creating the cyclonic action using a simple input ducting arrangement.

Another objective is to provide such a cyclonic dirt cup assembly in which the dirt cup may be easily removed from the vacuum cleaner for emptying of the contents thereof, and in which the cone may be separated from a support member to allow filter access for cleaning of the filter.

A further objective is to provide such a cyclonic dirt cup assembly which sustains performance of the vacuum cleaner by filtering the larger particles from the dirt-laden airstream using cyclonic action and filtering the smaller particles from the airstream using a filter.

A still further objective is to provide such a cyclonic dirt cup assembly which is of simple construction and which is achieves the state objectives in a simple, effective and inexpensive manner.

These and other objectives will be readily apparent from the following description taken in conjunction with the accompanying drawings.

In carrying out the invention in one form thereof, these objectives and advantages are obtained by providing a cyclonic dirt cup assembly including a container formed with an inlet opening for receiving a stream of dirt-laden air; an inverted truncated cone positioned within the container and being formed with a wall; and a baffle extending outwardly from the wall of the cone, said baffle being positioned adjacent to the inlet opening of the container and cooperating with said cone for directing the stream of dirt-laden air in a cyclonic manner.

BRIEF DESCRIPTION OF THE DRAWINGS

The preferred embodiment of the invention, illustrative of the best mode in which applicants have contemplated applying the principals is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
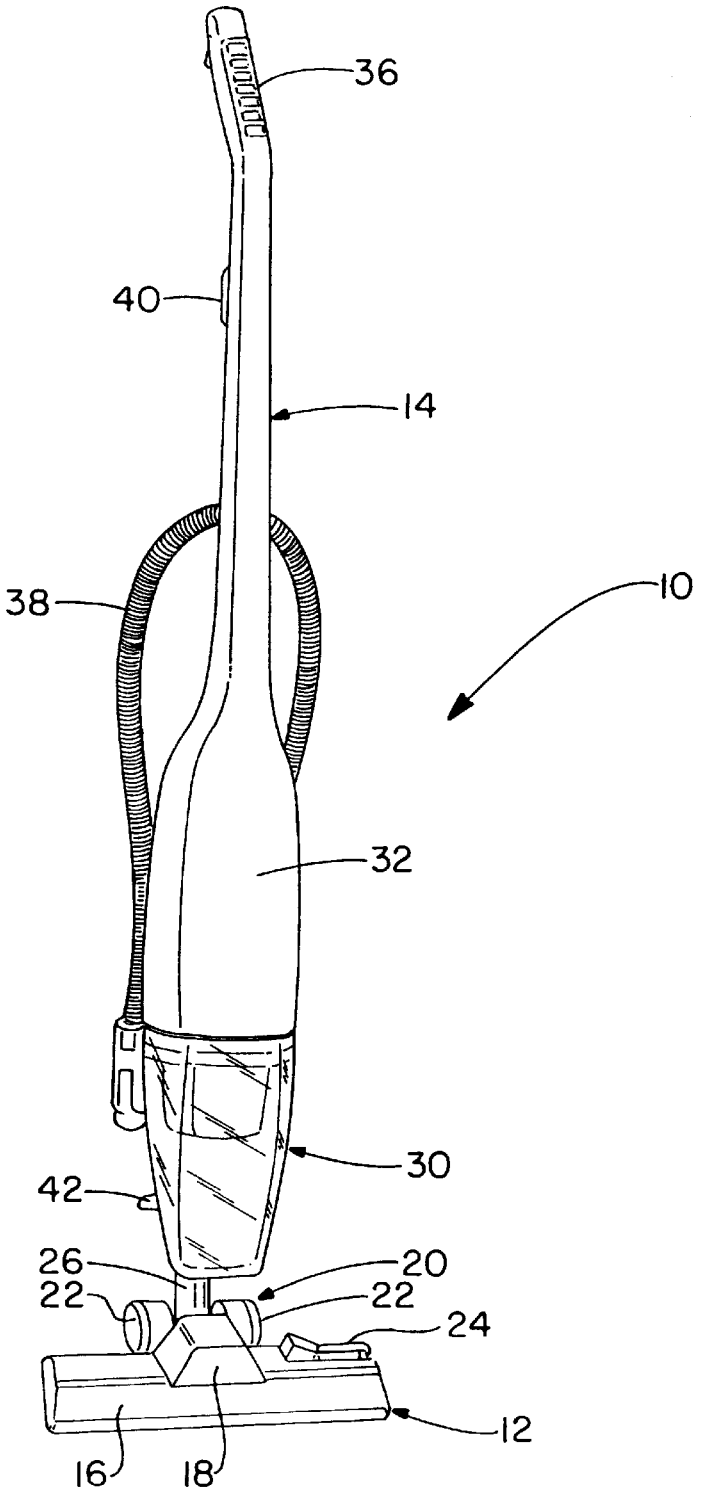
FIG. 1 is a perspective view showing the cyclonic dirt cup assembly of the present invention in one form thereof attached to a light-weight stick vacuum cleaner.

A light-weight stick vacuum cleaner of one type is shown in FIG. 1 and is indicated generally at 10. Vacuum cleaner 10 includes a foot or nozzle 12 and an upper handle 14. Foot 12 has a front portion 16 formed with a bottom nozzle opening (not shown) for receiving a stream of dirt-laden air, a raised central portion 18 which forms a dirt duct for conveying the dirt-laden air to upper handle 14, and a rear wheel assembly 20 having a pair of wheels 22 which allow vacuum cleaner 10 to be easily manipulated across a floor surface to be cleaned. A brush adjustment switch 24 is formed on front portion 16 which controls a brush strip (not shown) on the bottom of the foot allowing the brush strip to be placed in either a floor engaging or a floating position.

Upper handle 14 is connected to foot 12 by a suction tube 26 pivotally mounted to rear wheel assembly 20 and fluidly communicating with the duct formed by raised central portion 18 and the nozzle opening (not shown). Upper handle 14 includes a cyclonic dirt cup assembly of the present invention in one form, indicated at 30, which receives and filters the dirt-laden air as it exits from suction tube 26 and before it enters a motor-fan housing 32 which houses a motor-fan assembly 34 (shown in dot-dash lines in FIG. 2). Upper handle 14 further includes an upper hand grip portion 36 and may also include an attachment hose 38 (FIG. 1) which allows vacuum cleaner 10 to be converted between "on-the-floor cleaning" and "above-the-floor cleaning" modes. Top and bottom hooks 40 and 42, respectively, are positioned on the rear of upper handle 14 and function as a cord wrap to allow the electrical cord of vacuum cleaner 10 to be easily stored when vacuum cleaner 10 is not in use.

In the illustrated preferred form of the present invention, cyclonic dirt cup assembly 30 releasably mounts on upper handle 14 (FIG. 2) and includes a dirt cup or dirt receiving container 50 and a cyclonic filter assembly 52. Dirt cup 50 includes a bottom wall 54 and a curved wall 56 extending upwardly from bottom wall 54. Wall 56 is tapered inwardly from the top to the bottom thereof and includes a front 58, a rear 60 and a pair of opposed sides 62. A latch 64 is pivotally mounted to the outer surface of bottom wall 54 to releasably retain dirt cup 50 on upper handle 14. Latch 64 includes a front handle portion 66, a rear barbed portion 68 and pivots about a pivot point 70, whereby an upward pressure applied to handle 66 releases barbed portion 68 from its engagement with a catch 72 formed on upper handle 14 of vacuum cleaner 10. Latch 64 is spring biased to the position of FIG. 2 allowing dirt cup 50 to be easily placed and retained on upper handle 14. Latch 64 is further described in U.S. Pat. No. 5,659,922 assigned to the assignee of the present invention and incorporated herein by reference.

Rear 60 of dirt cup 50 is formed with a longitudinally extending recess 75 (FIGS. 2 and 7) which receives suction tube 26 when dirt cup 50 is attached to upper handle 14, and which forms a flat vertically extending recessed wall 76. An inlet opening 80 to the dirt cup is formed in recessed wall 76 thereof which communicates with an outlet opening 82 (FIG. 2) formed in suction tube 26. A gasket or seal 84 is positioned between recessed wall 76 and suction tube 26 to seal the fluid connection between outlet opening 82 and inlet opening 80.

Bottom wall 54 and wall 56 form a dirt-collecting chamber 88 within dirt cup 50 which collects the dirt and debris filtered from the dirt-laden airstream by cyclonic filter assembly 52, as described hereinbelow. Dirt-collecting chamber 88 also functions as a cyclone chamber, wherein the cyclonic action created by cyclonic filter assembly 52 acts to filter dirt, dust and debris from the dirt-laden airstream. Dirt cup 50 is formed with an open top 90 which receives filter assembly 52, and which allows wall 56 to overlap an inwardly stepped portion 92 of motor-fan housing 32 to form an labyrinth seal therewith.

Figure 4:
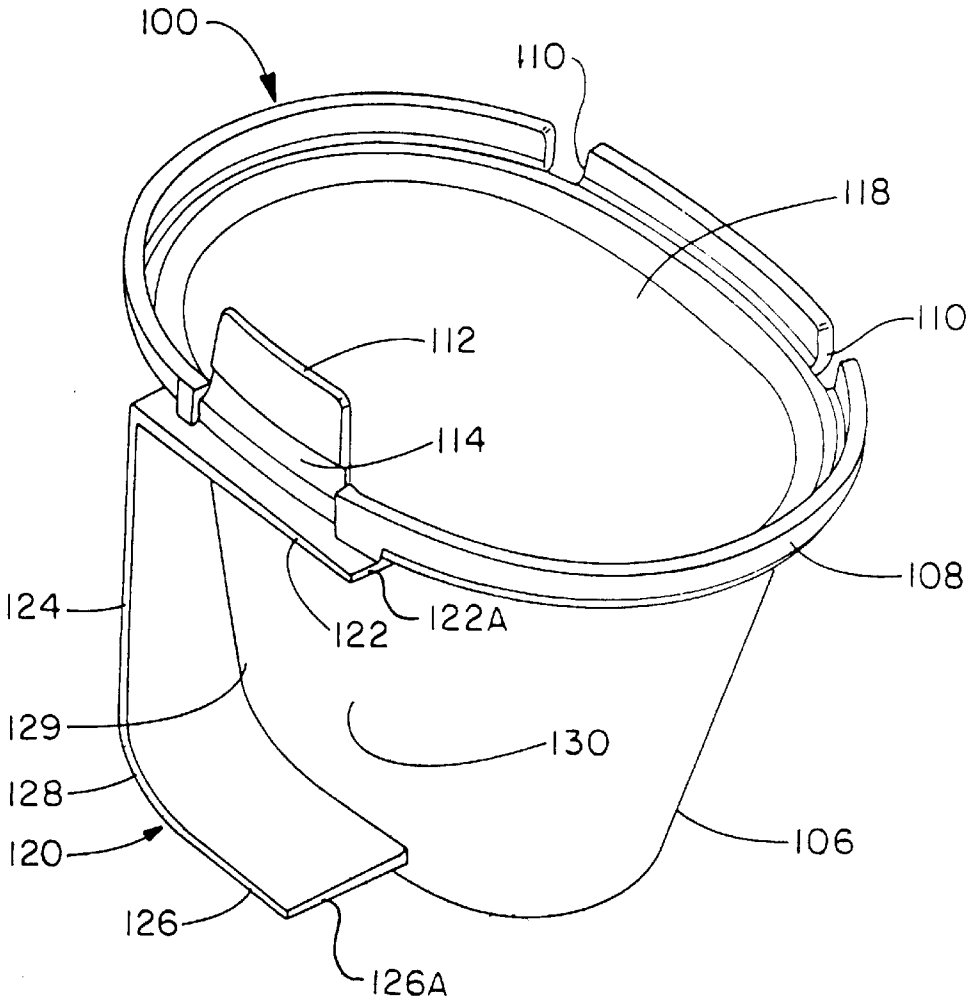
FIG. 4 is a perspective view of the cone of the cyclonic dirt cup assembly of FIG. 3.

In the preferred embodiment of the present invention, cyclonic filter assembly 52 includes an inverted truncated cone 100 (FIGS. 3 and 7) pivotally connected to a support frame member 102, and a filter bag 104 which extends upwardly from support frame member 102 in a direction opposite that of cone 100. Cyclonic filter assembly 52 may include a mesh screen, filter cartridge or other suitable filter rather than filter bag 104, or may be free of an additional filtering element without affecting the concept of the invention. Cone 100 is generally elliptical in cross section and is formed with a front wall 105, a pair of side walls 106 and a rear wall 107. Walls 105–107 are form an outwardly extending top lip 108 on cone 100. Lip 108 is formed with a pair of front notches 110 (FIG. 4) which provide sufficient flexibility to lip 108 to allow lip 108 to pivot over a front bottom edge 109 of frame member 102 (FIG. 3), as described below. Alternatively, cone 100, and thus lip 108, may be formed of a material which provides sufficient flexibility to lip 108 to allow lip 108 to flex over front bottom edge 109 when cone 100 is pivoted to the assembled position of FIG. 2.

A tab 112 extends upwardly from cone 100 and provides an attachment surface to allow cone 100 to be stapled, glued, sewn or otherwise attached to frame member 102. Alternatively, tab 112 could be formed integrally with supporting frame member 102 allowing frame member 102 and cone 100 to be formed as a one-piece member. A living hinge 114 is formed between tab 112 and the top edge of lip 108 to allow cone 100 to pivot in the direction of arrow A (FIG. 3). Living hinge 114 allows cone 100 to pivot between the assembled, dirt collecting position of FIG. 2 and the pivoted dirt emptying position of FIG. 3.

Walls 105–107 taper inwardly from top to bottom and form a generally elliptical or oval-shaped bottom opening 116 and a generally elliptical or oval-shaped top opening 118 which is larger in circumference than bottom opening 116. Tapered walls 105–107 forms a downwardly angled surface which acts to direct the incoming dirt-laden airstream in a downward direction and assists in maintaining the cyclonic action within chamber 88.

Figure 6:
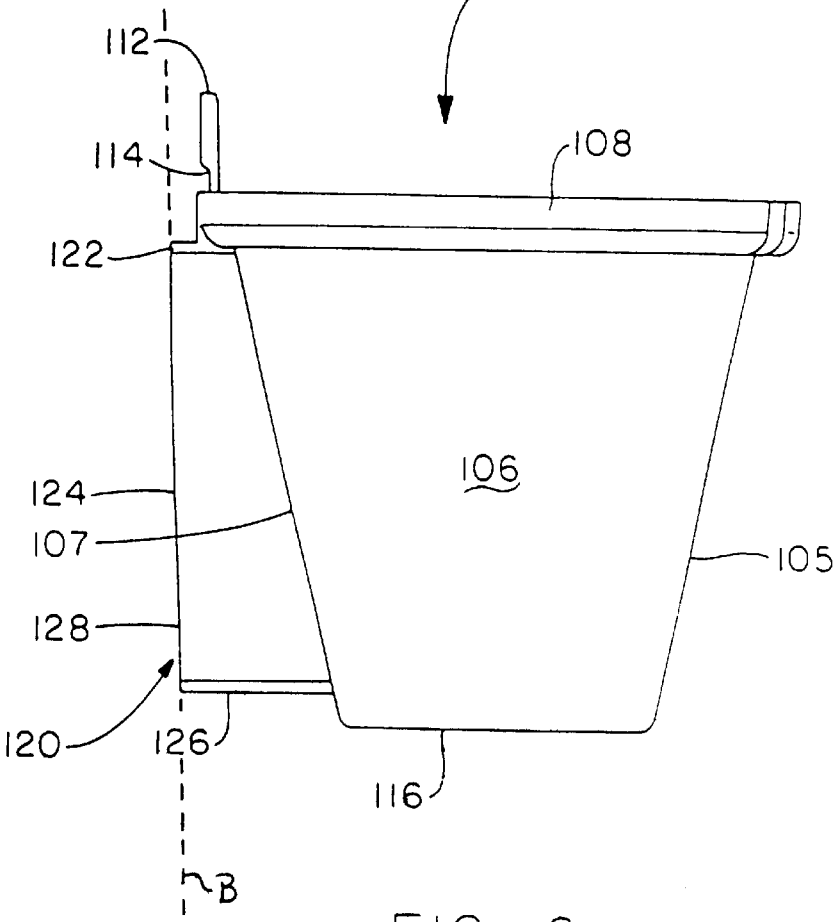
FIG. 6 is a side elevational view of the cone of FIG. 5.
Figure 5:
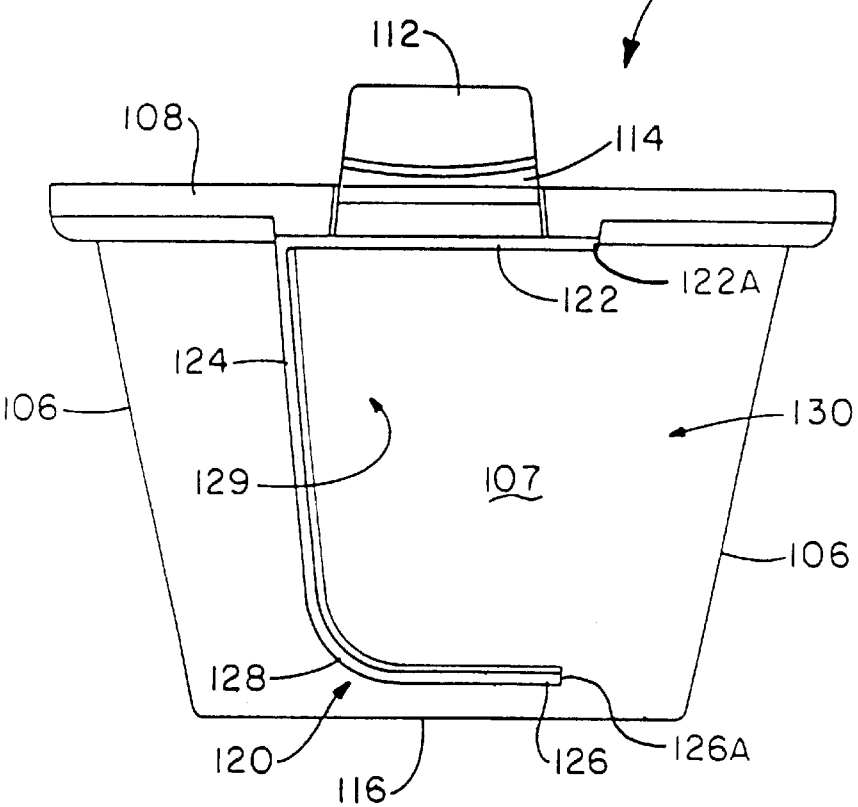
FIG. 5 is a rear elevational view of the cone of FIG. 4.

In accordance with one preferred form of the present invention, an air-directing baffle 120 (FIGS. 4–6) is provided which extends outwardly from rear wall 107 of cone 100. Baffle 120 cooperates with rear wall 107 for directing the input stream of dirt-laden air in a cyclonic manner. Baffle 120 also functions as an airflow impediment which impedes a portion of the cyclonically flowing airstream and assists in separating the dirt particles from the dirt-laden airstream, as described herein below.

In the illustrated preferred embodiment, baffle 120 is formed integrally on rear wall 107 and includes a horizontally extending top wall 122 having an outer end 122A (FIGS. 4 and 5), a slightly angled vertical side wall 124, and a generally horizontally extending bottom wall 126 which is connected to side wall 124 by a radiused corner 128 and which has an outer end 126A. Top wall 122, side wall 124 and bottom wall 126 terminate in a common vertical plane B (FIG. 6) and abut the inner surface of vertically extending recessed wall 76 to substantially seal baffle 120 against wall 76. Walls 122, 124, 126 of baffle 120 are positioned about inlet opening 80 whereby the baffle walls, recessed wall 76 and rear wall 107 of cone 100, form an air directing compartment 129 which surrounds or encloses inlet opening 80 (FIG. 7) and receives the dirt-laden air input into dirt cup 50 through inlet opening 80. A horizontal airflow exit opening 130 is formed between outer ends 122A and 126A of top wall 122 and bottom wall 126, respectively, which provides a tangential opening for the dirt-laden air to exit air directing compartment 129 and begins the cyclonic action within chamber 88.

Supporting frame member 102 is generally complementary in shape to open top 90 of dirt cup 50 and is received therein whereby the outer surface of frame member 102 abuts the inner surface of dirt cup 50 in a substantially sealing engagement. By substantially sealing the contact between frame member 102 and dirt cup 50, the cyclonically filtered airstream exiting chamber 88 via opening 118 is directed upwardly through a central opening (not shown) formed in frame member 102. Supporting frame member 102 is formed with a plurality of notches 132 along the bottom edge thereof which receive corresponding support flanges 134 formed on the inner surface of dirt cup 50 to suspend frame member 102 within chamber 88.

Filter bag 104 is attached to the perimeter of the central opening of frame member 102 and extends upwardly toward motor-fan assembly 34. Filter bag 104 receives the cyclonically filtered airstream flowing upwardly through the interior of cone 100 and exiting cone 100 through top opening 118 thereof, and though the opening of frame member 102 to further filter the airstream before the airstream enters motor-fan assembly 34.

Figure 2:
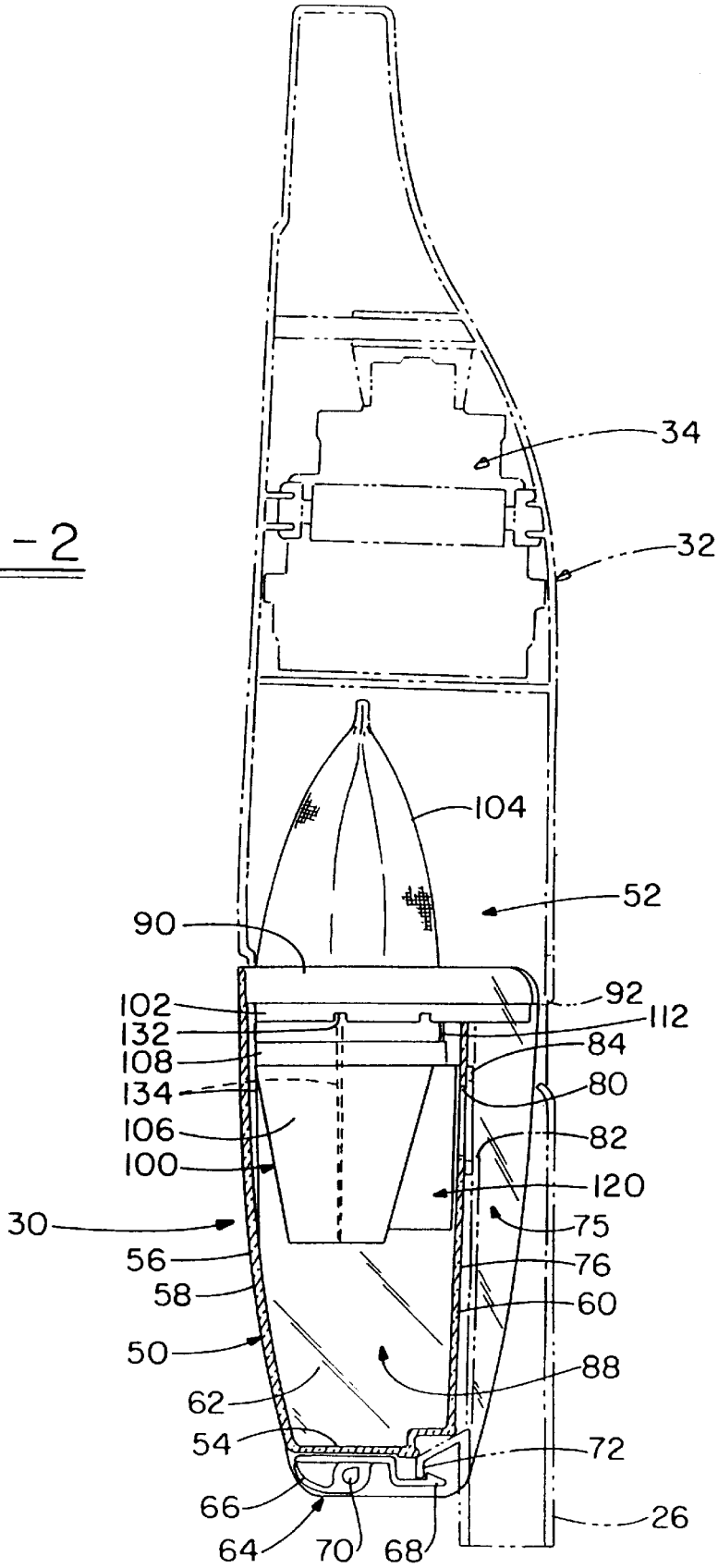
FIG. 2 is a side elevational view of the cyclonic dirt cup assembly of FIG. 1 with a portion of the light-weight stick vacuum cleaner shown in dot-dash lines.
Figure 3:
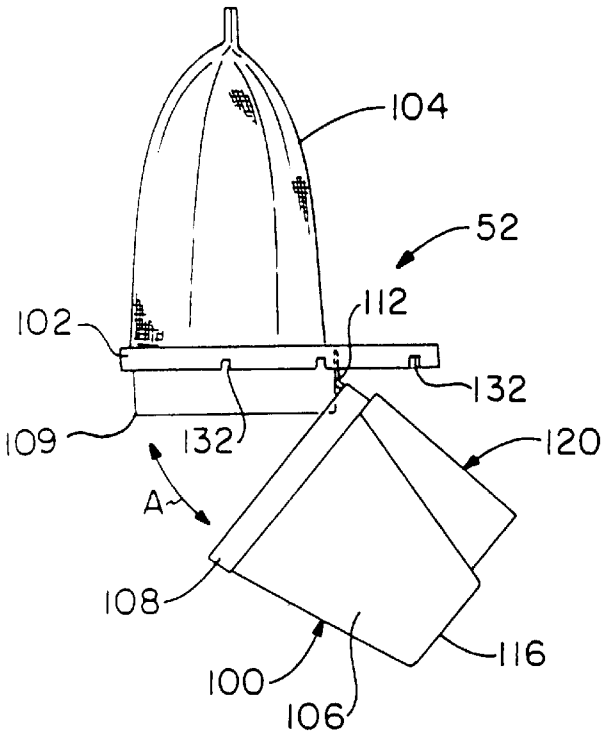
FIG. 3 is a side elevational view of the cyclonic dirt cup assembly of FIG. 2 showing the pivotal movement of the cone relative to the supporting frame member.

Referring to FIGS. 1 and 2 in operation, motor-fan assembly 34 creates a suction in the bottom opening of foot 12 which picks up dirt, dust and debris from a floor surface being cleaned and which produces a dirt-laden airstream. The dirt-laden airstream flows through the dirt duct formed by raised central portion 18 of foot 12, through suction tube 26 and out suction tube outlet 82. As the dirt-laden airstream exits suction tube 26 through outlet 82, the airstream enters dirt cup 50 through inlet opening 80 and in a generally radial or perpendicular direction relative to cone 100. The dirt-laden airstream contacts downwardly angled rear wall 107 of cone 100 producing a downward component to the airstream. A portion of the air flow will contact and travel downwardly along baffle side wall 124 whereby radiused corner 128 creates a smooth transition of the air stream between the vertical direction created by rear wall 107 and the horizontal direction created by bottom wall 126 of baffle 120. As the airstream flows along bottom wall 126 it is directed out of air directing compartment 129 through airflow exit opening 130 in a generally tangential direction relative to cone 100, thus creating a cyclonic action within chamber 88. This tangential airstream flowing along bottom wall 126 will also produce a horizontal component to the remaining portion of the airstream flowing downwardly along tapered rear wall 107 of cone 100.

This tangentially directed airstream creates a cyclonic action within chamber 88 which allows larger dirt particles contained in the cyclonic airstream to fall therefrom due to the force of gravity. Further, as a portion of the airstream flows within the upper section of dirt cup 50, the airstream will eventually flow into the rear surface of baffle side wall 124 causing the dirt particles carried by the airstream to hit baffle side wall 124 losing their horizontal velocity. The force of gravity will pull the dirt particles to the bottom of dirt cup 50 where the dirt particles will collect until dirt cup 50 is emptied.

The remaining portion of the airstream will continue to flow in a circular direction about the lower section of dirt cup 50. As this remaining portion of the airstream reaches the bottom of chamber 88, the air flow will be drawn upwardly through bottom opening 116 and top opening 118 of cone 100, and through the opening formed in frame member 102 before flowing into filter bag 52. Filter bag 52 further filters the smaller dirt particles from the airstream and emits a clean filtered airstream to motor-fan assembly 34. The clean filtered air flows through motor-fan assembly 34 and is emitted to the atmosphere. By filtering the larger dirt particles from the airstream prior to the airstream flowing into the filter bag, performance of the vacuum cleaner is sustained as the larger particles will not flow into and clog the filter bag.

Figure 7:
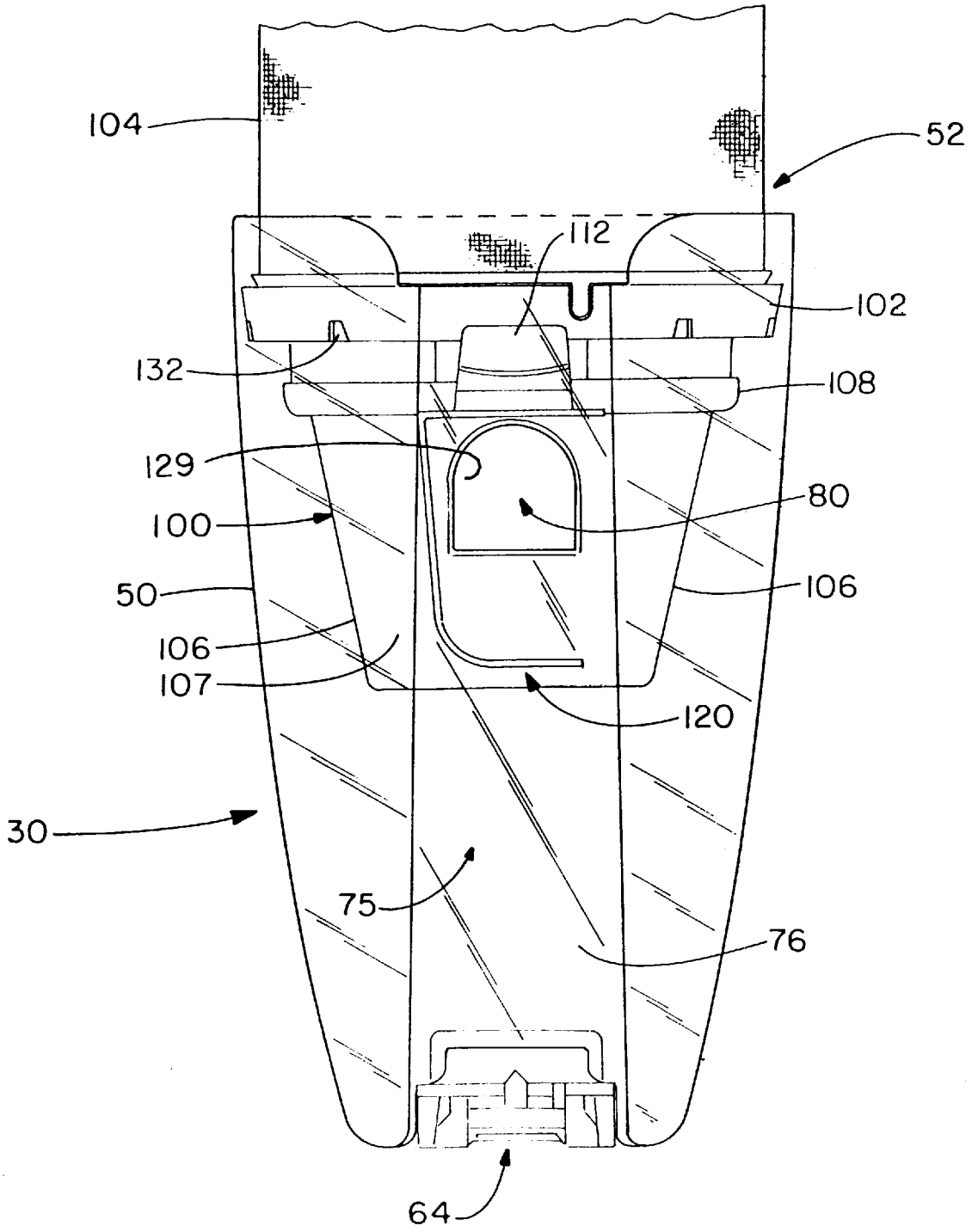
FIG. 7 is a rear elevational view of the cyclonic dirt cup assembly.

It is understood that although the stream of dirt-laden air is shown in FIGS. 2 and 7 being input into chamber 88 in a radial direction, the stream of dirt-laden air may be input into chamber 88 at various other angles with baffle 120 directing the airstream tangentially to create the cyclonic action within chamber 88. For example, the airstream may be input tangentially. In such a tangentially input arrangement, baffle 120 assists in creating the cyclonic action by blocking or shielding the top, bottom and one side of input opening 80 to prevent the cyclonically flowing air within chamber 88 from affecting the incoming airstream. The airstream may also be input into chamber 88 at a vertical angle wherein the airstream will contact either top wall 122 or bottom wall 126 before being directed tangentially out airflow exit opening 130.

Accordingly, cone 100 and baffle 102 create and maintain a cyclonic action within chamber 88 from a stream of dirt-laden air which may be input into chamber 88 at various angles. This cyclonic action filters larger dirt particles from the dirt-laden airstream with filter bag 52 filtering the smaller dirt particles from the dirt-laden airstream. Dirt cup 50 may be easily removed from its attachment to upper handle 14 by pivoting latch 64 and applying an outward and downward force on dirt cup 50. Cyclonic filter assembly 52 including cone 100, frame member 102 and filter bag 104, may be lifted from its placement within dirt cup 50 allowing the dust and dirt collected in chamber 88 to be easily emptied from dirt cup 50. Cone 100 maybe pivoted about living hinge 114 allowing any dirt or debris to be emptied from filter bag 104. Cone 100 may be pivoted back to the assembled position on frame member 102 with notches 110 providing sufficient flexibility to allow lip 108 to clear the front bottom edge 109 of frame member 102. As cyclonic filter assembly 52 is placed back into dir cup 50, bottom wall 126 of baffle 120 may cam against the inner surface of recessed wall 76 thus maintaining both the engagement between lip 108 and frame member 102 and the engagement between baffle 120 and recessed wall 76. Notches 132 formed in frame member 102 rest against support flanges 134 to suspend cyclonic filter assembly 52 within chamber 88.

Accordingly, the improved cyclonic dirt cup assembly is simplified, provides an effective, inexpensive, and efficient device which achieves all of the enumerated objectives. While there has been shown and described herein a preferred embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. A cyclonic dirt cup assembly for a vacuum cleaner, said cyclonic dirt cup assembly including:

a container formed with an inlet opening for receiving a stream of dirt-laden air;

an inverted truncated cone positioned within the container and being formed with a wall, said wall having an outer surface; and a baffle extending outwardly from the outer surface of the wall of the cone, said baffle being positioned adjacent to the inlet opening of the container and cooperating with said cone for directing the stream of dirt-laden air in a cyclonic manner about said outer surface of the wall of the wall of the cone.

2. The assembly defined in claim 1 in which the stream of dirt-laden air is input into the container generally perpendicularly to the wall of the cone.

3. The assembly defined in claim 1 in which the baffle is positioned about the inlet opening.

4. The assembly defined in claim 1 in which the container includes a wall; in which at least a portion of the baffle abuts said container wall; and in which the baffle, the wall of the cone and the container wall form an air directing compartment which receives the stream of dirt-laden air.

5. The assembly defined in claim 4 in which the air directing compartment is formed with an airflow exit opening for directing the stream of dirt-laden air generally tangentially relative to the cone.

6. The assembly defined in claim 1 in which the baffle includes a top wall, a side wall and a bottom wall.

7. The assembly defined in claim 2 in which a curved corner is formed between the side wall and the bottom wall of the baffle.

8. The assembly defined in claim 1 further including a removable frame member positioned within the container, said frame member having a top and a bottom.

9. The assembly defined in claim 8 in which the cone is attached to the bottom of the frame member.

10. The assembly defined in claim 9 further including a filter attached to the top of the frame member.

11. The assembly defined in claim 10 in which the cone is pivotally attached to the bottom of the frame member, said cone being pivotable away from said frame member to provide access to the filter for cleaning thereof.

12. The assembly defined in claim 8 in which the cone includes an outwardly extending top lip which overlaps the bottom of the frame member to substantially seal the cone with the frame member.

13. The assembly defined in claim 12 in which a notch is formed in the lip to provide sufficient flexibility to said lip, allowing said lip to pivot over a front edge of the bottom of the frame member.

14. The assembly defined in claim 8 further including a filter attached to the frame member.

15. A cyclonic dirt cup assembly for a vacuum cleaner, said cyclonic dirt cup assembly including:

a container formed with an inlet opening for receiving a stream of air;

a frame member removably mounted within the container;

a filter attached to the frame member, said filter being formed of an air permeable material for filtering the stream of air as said stream of air passes through said filter; and a cone positioned within the container and pivotally attached to the frame member, said cone being pivotable away from said frame member to provide access to the filter for cleaning thereof.

16. The cyclonic dirt cup assembly defined in claim 15 in which the frame member includes a top and a bottom, and in which the filter is attached to the top of said frame member and the cone is pivotally attached to the bottom of said frame member.

17. The cyclonic dirt cup assembly defined in claim 16 in which the filter is a filter bag which extends upwardly from the top of the frame member.

18. The cyclonic dirt cup assembly defined in claim 15 in which a baffle extends outwardly from a wall of the cone, said baffle being positioned adjacent to the inlet opening of the container and cooperating with said cone for directing the stream of dirt-laden air in a cyclonic manner.

19. The cyclonic dirt cup assembly defined in claim 15 in which the stream of dirt-laden air is input into the container generally perpendicularly to the wall of the cone.

20. The assembly defined in claim 18 in which the baffle is positioned about the inlet opening; in which the container includes a wall; and in which the baffle, the wall of the cone and the container wall form an air directing compartment which receives the stream of dirt-laden air.

* * * * *

UNITED STATES PATENT AND TRADEMARK OFFICE

CERTIFICATE OF CORRECTION

PATENT NO. : 6,146,434
DATED : November 14, 2000
INVENTOR(S) : Adam C. Sclalfani, Douglas E. Gerber, Raymond L. Lawter, Daniel R. Miller It is certified that error appears in the above-identified patent and that said Letters Patent is hereby corrected as shown below:

Title page,
Item [75], the first named joint inventor in the Inventors Field.
should be amended to read: Adam C. Sclafani Signed and Sealed this Sixth Day of November, 2001

*Attest:*

Nicholas P. Godici

*Attesting Officer*

NICHOLAS P. GODICI
*Acting Director of the United States Patent and Trademark Office*